United States Patent [19]

Katz

[11] Patent Number: 4,466,374

[45] Date of Patent: Aug. 21, 1984

[54] FABRIC WIND SHIELD AND STORAGE DEVICE FOR BOATS

[76] Inventor: Sheldon Katz, 211 Roanoke Ave., Riverhead, N.Y. 11901

[21] Appl. No.: 425,642

[22] Filed: Sep. 28, 1982

[51] Int. Cl.[3] ..... B63B 19/02

[52] U.S. Cl. ..... 114/71; 114/361

[58] Field of Search ..... 114/71, 361, 364; 160/368 S, DIG. 1, DIG. 2, DIG. 3; 296/78 R, 78.1, 37.8, 37.12, 37.13; D12/317; 224/273, 277

[56] References Cited

U.S. PATENT DOCUMENTS

| | | | |
|---|---|---|---|
| 277,146 | 5/1883 | Mansfield | 114/361 |
| 1,289,978 | 12/1918 | Ward | 224/273 |
| 1,523,323 | 1/1925 | Wensinger | 296/37.13 |
| 2,308,109 | 1/1943 | Rundquist | 114/361 |
| 2,616,554 | 11/1952 | Wade et al. | 224/273 |
| 2,887,216 | 5/1959 | Hargraves | 224/277 |
| 2,974,329 | 3/1961 | Welch | 114/361 |

*Primary Examiner*—Trygve M. Blix
*Assistant Examiner*—Patrick W. Young
*Attorney, Agent, or Firm*—Kevin Redmond

[57] ABSTRACT

A fabric wind shield replaces conventional wind shields especially for use in boats having a central cockpit. The wind shield contains pockets on either side which are expandable to provide convenient and variable storage areas and on which windows are provided to permit visual determination of the contents.

2 Claims, 4 Drawing Figures

FABRIC WIND SHIELD AND STORAGE DEVICE FOR BOATS

BACKGROUND

1. Field

This invention relates to fabric wind shields for boats and, more particularly, to such wind shields designed to replace clear plastic wind shields in boats having centrally located cockpits.

2. Prior Art

Most prior art boats use clear plastic wind shields even though there is often no need to see through wind shields. This is especially true in boats having centrally located cockpits because the operator usually stands or sits in a position well above the wind shield. Despite this fact, most boats of this type install clear plastic wind shields which become scratched and serve very little functional purpose other than to fend off wind directed mostly at the lower part of the operator's body. This function could as well be carried out by an opaque wind shield such as a fabric wind shield which would not suffer from scratching as does the plastic wind shield. Convenient storage space, which is usually in demand in small boats, can be provided by such a fabric wind shield at low cost.

A number of prior art fabric wind shields are available as evidenced by U.S. Pat. Nos. 2,308,109, 1,481,548, 2,817,859, 804,154 and 804,155. In the first of these U.S. patents, a collapsible windspray shield is illustrated. This device is primarily designed to serve simply as a wind shield in boats which have none and its primary advantage is its ability to be collapsed. It contains pockets which are, in reality, small passageways intended to pass support rods. There is no storage provided by this device and it is not intended to use an existing wind shield support, but must use its own specially designed support system. It therefore is not readily adaptable to boats having an existing wind shield support system.

The second U.S. Pat. No. 1,481,548, shows a collapsible wind shield, however, this wind shield is not intended for use in boats and it provides no storage space. U.S. Pat. No. 2,817,859 shows a fabric wind shield designed for boats. However, it is an unusual design requiring the wind shield to be placed immediately above the gunwales and it fails to provide any storage space.

U.S. Pat. Nos. 804,154 and 804,155 show a fabric wind shield designed for small boats. This wind shield is also placed immediately above the gunwale and fails to provide any storage space.

SUMMARY

It is an object of the present invention to provide an expandable and conveniently located storage space for boats at low cost.

It is an object of the present invention to provide a storage device for boats which can replace an existing wind shield and be secured to the existing wind shield frame.

It is an object of the present invention to provide a boat wind shield having the capability of being adapted to a variety of existing wind shield frame sizes.

It is an object of the present invention to provide a weather-tight boat wind shield designed to eliminate damage such as scratching and crazing encountered with clear plastic wind shields.

It is an object of the present invention to provide a storage device for boats in which the contents can be determined rapidly by visual means.

The present invention is a boat wind shield made from a durable fabric, such as canvas or fibreglass-reinforced nylon, rather than the usual clear plastic. It is especially advantageous for boats having a central cockpit location because wind shields in such boats may be completely opaque without affecting the visibility of the operator, since the operator is normally positioned with his eye level well above the wind shield.

The wind shield is formed of a first fabric sheet having a peripheral contour which conforms to that of the wind shield frame. This sheet is typically secured to the wind shield frame by means of a line passed through grommets located about the sheet's periphery. Alternatively, snaps, wing nuts, springs or similar devices may be used for securing.

A pocket formed on the outside of the wind shield is covered with a flap-type cover to protect the pocket contents from the elements. The flap cover is detachably secured to the face of the pocket by means of contact pressure fasteners, such as velcro fasteners. The cover is designed to be secured in one of several locations to permit the pocket to be expanded as desired to accommodate various storage items. The pocket side panels are pleated as well to aid in accommodating different size objects. The center of the pocket includes an internal contact pressure fastener to permit the pocket to be divided into two, for smaller objects, or alternatively opened to form a single large pocket. The pockets contain clear plastic windows enabling the user to determine the contents at a glance. Pockets of this type are placed on both sides of the wind shield, greatly expanding the storage capability of the boat at low cost.

DETAILED DESCRIPTION OF THE INVENTION

Figure 1A:
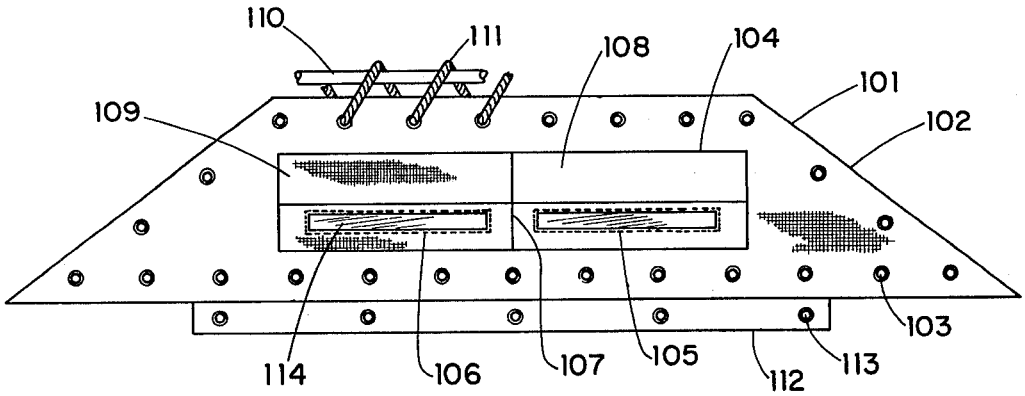
FIG. 1A is a plan view of the invention with the side panels unfurled, illustrating one method of securing the wind shield into the wind shield frame.

FIG. 1 shows the invention 101 to comprise a first sheet of fabric 102 cut with peripheral contours designed to match the wind shield frame of a boat. About the periphery of this sheet are grommets or snaps 103 used for fastening the wind shield to the wind shield frame. The forward face of the first sheet shown in this Figure includes a large pocket 104 which is divided into two smaller pockets as indicated by pocket dividing line 107. Each segment of the pocket includes a cover, such as covers 108 and 109 and corresponding pocket segments 105 and 106. The pocket segments include windows such as window 114 to view the contents of the pocket without opening the covers. The windows are formed of plastic sheets secured to the fabric usually by positioning them in compartments sewn into the fabric wind shield. This arrangement facilitates replacement of the windows as required.

A section of a wind shield frame 110 is shown located above the sheet 102 along with a lashing line 111 which passes through the grommets and over the frame 110, securing the sheet 102 to the frame. On the lower side of the sheet 102 is a weather-tight extension 112 containing a series of grommets 113.

In the use of the fabric wind shield shown in FIG. 1A, the normally plastic wind shield is removed and replaced by the fabric wind shield 101. The periphery of the sheet 102 contains a series of grommets 103, snaps or other types of fastening means to permit the wind shield to be secured to the frame. Where grommets are used, a lashing line is passed through the grommets and about the frame, securing the wind shield in place. Note that the wind shield need not fit the wind shield frame exactly, as the difference between the sheet size and wind shield frame can be taken up by an extra length of lashing line, thereby permitting one size of the wind shield to fit a number of different size wind shield frames. The extension 112 is used to secure the lower portion of the wind shield to the support means for the wind shield frame or directly to a deck to provide an improved weather-tight seal.

Figure 1B:
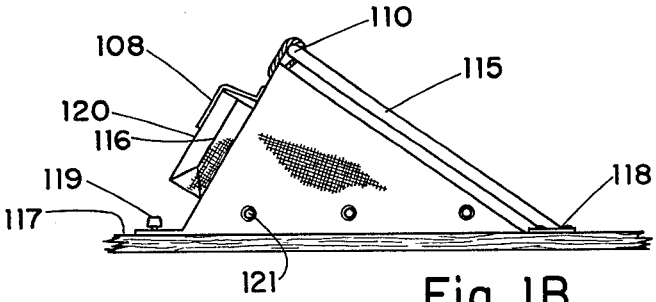
FIG. 1B is a side view of the present invention, illustrating a method of securing the side panels.

FIG. 1B is a side view of a mounted wind shield. A side rod 115 of the wind shield frame is shown mounted by way of bracket 118 to a deck 117. The side view of the pocket 104 illustrates its side panel 120 which includes an expansion pleat 116. The pleat is used to aid the pocket in expanding to accommodate a full load, and then permit the pocket to contract and lay flat against the wind shield when the load is removed. It can be seen from FIG. 1B that the pocket location has been selected to provide a head rest for personnel lying on deck 117 by simply inserting cushioning material in the pocket. A turn fastener is shown securing the extension 112 to the deck 117 and snap fasteners 121 securing the side panels to the frame. The extension when secured to the deck in this way provides an improved weather-tight seal.

Figure 2:
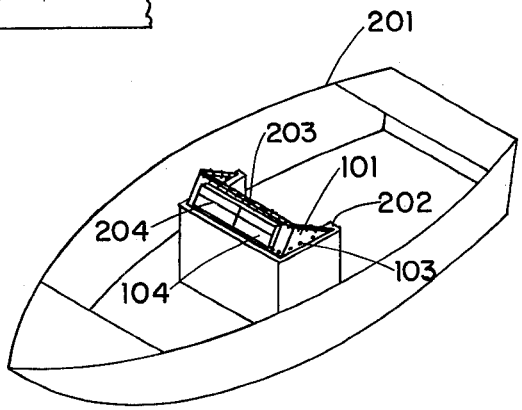
FIG. 2 is a perspective view of the present invention as installed in a boat having a centrally located cockpit.

FIG. 2 is a perspective view showing the use of the present invention in a boat 201 having a centrally located cockpit 202. The location of the wind shield 101 lashed to the frame 202, positions the pockets near the cockpit, providing the operator with a convenient and adaptable storage space at low cost. No built-in cabinets or alterations of the boat are required. Although one pocket is shown for illustrative purposes, a number of pockets are normally placed on both in the side panels and on the opposite face of the wind shield, providing a significant amount of storage space in a previously unused area.

Figure 3:
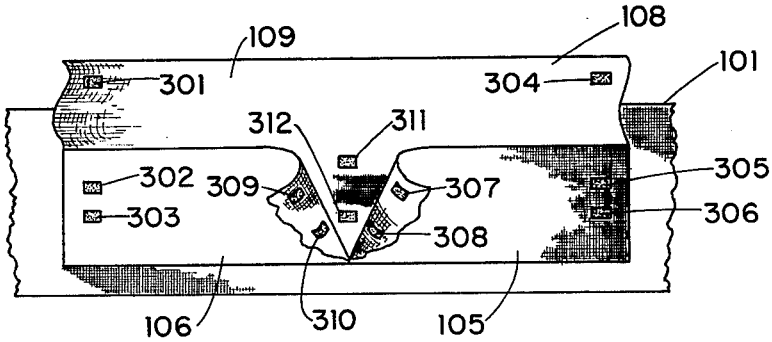
FIG. 3 is a broken away view of the pocket, illustrating one expandable feature provided by means of contact fasteners.

FIG. 3 illustrates the internal portions of the pocket. The covers 108 and 109 includes pressure contact fasteners such as fasteners 301 and 304. These fasteners are secured by merely applying pressure to two matching portions which form the complete fastener. These fasteners are released by forcibly disengaging the two portions. On the open face of the pocket segment 106 are matching portions of the pressure contact fasteners 302 and 303, enabling the fastener 301 on the underside of cover 109 to engage either fastener 302 or 303. The upper pressure contact fastener 302 or the lower one 303 may be selected, depending on the size of the articles to be stored. Similar matching fastener portions 305 and 306 are located on the adjacent pocket face for engaging fastener 304 on the underside of cover 108.

The center of the pocket is broken apart to illustrate the internal structure comprising six pressure contact fasteners 307 through 312. To divide the pocket, the fasteners 307 and 309 are pressed into matching fastener 311, while fasteners 308 and 310 are pressed into matching fastener 312. Where a larger article is to be stored, the pressure contact fasteners are disengaged and the entire length of the pocket may be used to store the article.

It is understood that although pressure contact fasteners have been used for illustrative purposes, other types of fasteners may be employed without departing from the spirit of the invention. Similarly, other variations on the basic theme are considered within the scope of the invention as for example including a pleat on the bottom of the pocket along with pressure fasteners to permit securing the pocket in a neat, flat position against the wind shield when not in use. It should be apparent that the present invention is not restricted to replacing only plastic wind shields, but also other types including glass and plexiglass. In all cases, where lashing is used to secure the wind shield, an added safety feature is provided in that the operator and passengers may fully grip the wind shield frame.

Having described my invention, I claim:

1. A fabric wind shield for boats having a wind shield frame and means for supporting said frame, comprising:

(a) a first fabric sheet having a periphery which generally conforms to the wind shield frame, (b) means for fastening the periphery of the fabric sheet to the wind shield frame, (c) a pocket formed of a second sheet of fabric affixed along three of its edges to one face of said first sheet, (d) flap means for covering the pocket, (e) means for detachably securing the flap means to the pocket to provide a closure for the pocket, (f) means for expanding the pocket in depth and breath while maintaining pocket closure, and (g) a detachable internal divider means securing a portion of the pocket to the first fabric sheet.

2. A fabric wind shield as claimed in claim 1, wherein all detachable means for securing are formed of pressure contact type fasteners.

* * * * *